United States Patent [19]

Fox

[11] 4,181,603

[45] Jan. 1, 1980

[54] CAPSULE SORTING APPARATUS

[75] Inventor: William C. Fox, Monticello, Ind.

[73] Assignee: Eli Lilly and Company, Indianapolis, Ind.

[21] Appl. No.: 938,177

[22] Filed: Aug. 30, 1978

[51] Int. Cl.[2] ..... B07C 5/04

[52] U.S. Cl. ..... 209/682; 209/707; 209/634

[58] Field of Search ..... 209/680, 682, 707, 634

[56] References Cited

U.S. PATENT DOCUMENTS

| | | | |
|---|---|---|---|
| 2,356,295 | 8/1944 | Yost | 209/682 |
| 2,501,403 | 3/1950 | McKinsey | 209/682 X |
| 3,997,058 | 12/1976 | Greer et al. | 209/680 X |

FOREIGN PATENT DOCUMENTS

| | | | |
|---|---|---|---|
| 1268554 | 3/1972 | United Kingdom | 209/682 |

*Primary Examiner*—Joseph J. Rolla

*Attorney, Agent, or Firm*—Houston L. Swenson; Arthur R. Whale

[57] ABSTRACT

An apparatus is provided for sorting out pharmaceutical capsule components from assembled capsules and comprises a pair of spaced plates containing a plurality of holes which allow unassembled pharmaceutical caps and bodies to fall through the holes and yet retain assembled capsules.

6 Claims, 6 Drawing Figures

CAPSULE SORTING APPARATUS

BACKGROUND OF THE INVENTION

Two-piece pharmaceutical capsules have been used for several decades to contain pharmaceutical medication. The capsules are generally formed from a gelatin material and are of circular cross-section. Conventional capsules comprise a body section of a length which is slightly less than the length of the assembled capsule and a cap which telescopes over the body to contain the medication therein. Automated means have been developed to disassemble empty capsules, fill the bodies with the pharmaceutical powder and subsequently replace the cap over the body. To avoid the accidental separation of the bodies and caps when they are assembled, various means have been used to keep them in a sealed relationship, including sealing bands and interlocking indentations in the caps and bodies.

However, despite the attempts to avoid accidental separations, capsules still occasionally become separated prior to distributing them for marketing. It is therefore necessary to filter or sort out the unassembled capsule sections, a step which is frequently done manually. One apparatus that has been developed for automatically sorting caps and bodies from assembled capsules is described in U.S. Pat. No. 3,997,058, Greer et al., assigned to SmithKline Corporation and issued on Dec. 14, 1976. Apparatuses of this type, although capable of sorting out sections, utilize a rather complex combination of hardware and are not readily changed over for adaptation to other sizes of capsules.

SUMMARY OF THE INVENTION

My invention utilizes a relatively inexpensive combination of components which require nominal maintenance and cleanup time and can be quickly converted for handling different sizes of capsules. This apparatus is adapted to receive a batch of assembled capsules, caps and bodies which are then placed onto a conveyor plate that is coupled to a vibratory unit. The conveyor plate has spaced holes in it of a predetermined dimension. Positioned above this conveyor plate in a spaced relationship is an upper plate which has holes in coaxial alignment with the holes in the conveyor plate. The controlled vibratory action on the conveyor plate causes the capsules and capsule sections to move across the conveyor plate and try to drop through the spaced holes. However, the spacing of the two plates prevents assembled capsules from assuming the degree of inclination needed to drop through the holes of the conveyor plate. Assembled capsule components therefore continue to travel along the length of the conveyor plate and are collected at an exit chute. However, the holes in the upper plate and the spacing of the plates are of dimensions which allow the longer bodies to assume a partially vertical position inasmuch as one end of these bodies will protrude temporarily into the holes of the upper plate.

DESCRIPTION OF THE PREFERRED EMBODIMENT

Figure 1:
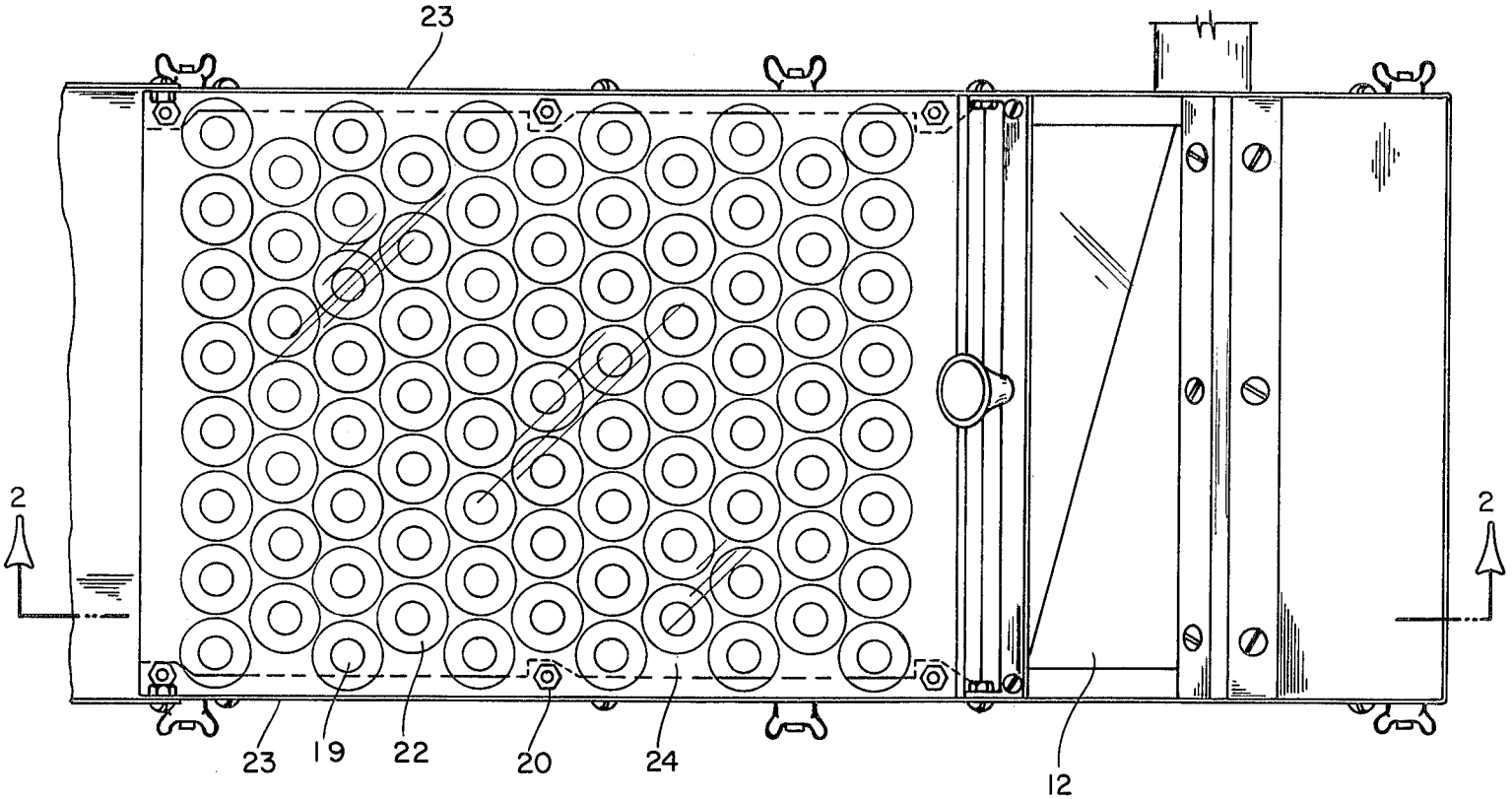
FIGS. 1, 2, and 3 are top, side and end views of the apparatus of this invention.
Figure 2:
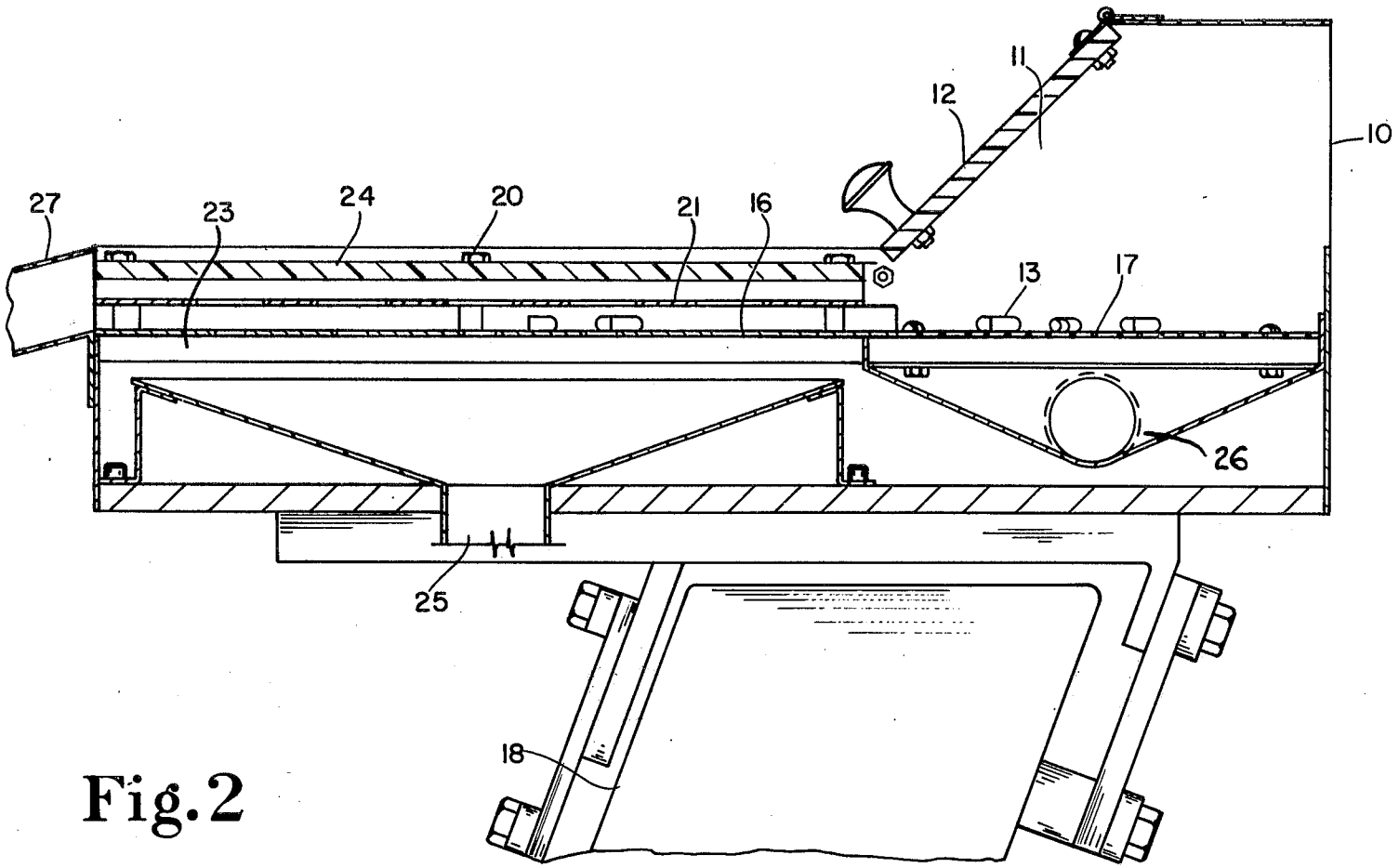
Figure 3:
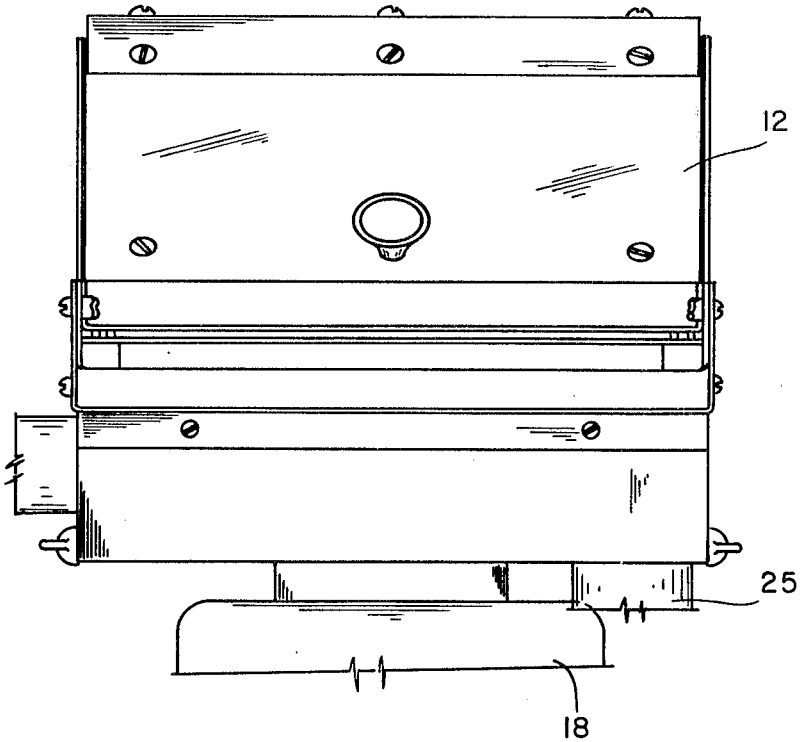

Refering to FIGS. 1–3, the apparatus of this invention has a compartment 11 for receiving batches of capsule components. The capsule components are admitted into compartment 11 through an open end 10 in the rear of the compartment. A hinged door 12 provides access to compartment 11 for dislodging any capsules jammed inside. As the capsule components, which may comprise either assembled capsules 13, capsule bodies 14 or capsule caps 15, are admitted into compartment 11 they fall onto a mesh section 17. Mesh section 17 may be formed from stainless steel number 6 mesh wire, 18 gauge. This mesh section is connected to an aluminum conveyor plate 16 and both the plate and section are connected to a bar frame 23. A vibratory drive 18 is connected to the bar frame. This drive has an adjustable means for varying the amount of vibration applied to the mesh section and conveyor plate which in turn affects the rate of travel of the capsule components.

As an open capsule section falls onto mesh section 17, the spilled powder is sucked into a collector 26. Otherwise, this powder will become lodged in the mesh and dampen the vibratory action as well as jamming other capsules. Conveyor plate 16 has a plurality of holes 19 positioned across its entire surface. Spaced above this conveyor plate by spacers 20 is an upper aluminum plate 21 which likewise has a plurality of spaced holes 22. Plates 16 and 21 may be formed from 1/16 inch material. Holes 22, which are in coaxial alignment with holes 19, are closely spaced and are of a larger diameter. Also shown in FIG. 2 is a plastic retaining plate 24 which is spaced and parallel to upper plate 21.

A receptacle 25 is positioned below the conveyor plate 6 for receiving capsule components as they exit through holes 19. An exit chute 27 is provided at the downstream end of the conveyor plate to receive assembled capsules 13 that have been sorted from the unassembled caps 15 and bodies 14.

Figure 4:
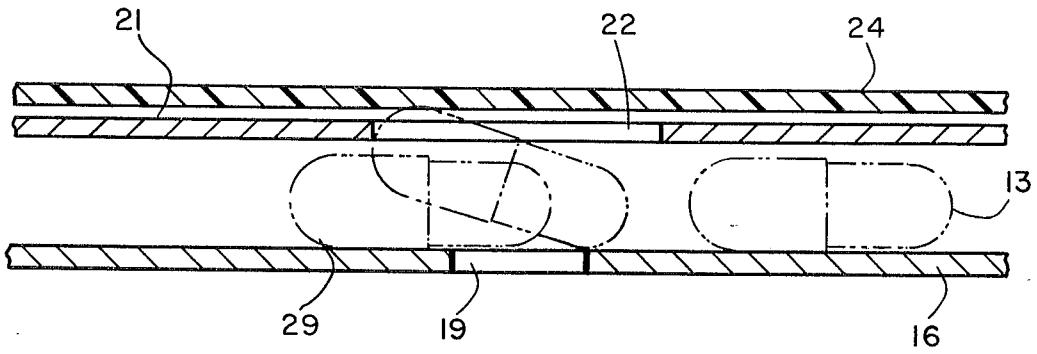
FIGS. 4, 5, and 6 are side views taken in cross-section of the two plates of the apparatus and illustrate the movement of capsules, capsules bodies and capsule caps between the two plates.

FIG. 4 illustrates the manner in which an assembled capsule moves along the vibrating conveyor plate and is retained. As a capsule passes across hole 19 the vibratory motion of the capsule will tend to cause it to either rise up into the upper hole 22 or downwardly into hole 19. In the event that the vibratory motion applied to conveyor 16 is excessive, the capsules might have a tendency to occasionally bounce upwardly into holes 22 of plate 21 and possibly fall through the lower holes 19. Consequently, retaining plate 24 is positioned slightly above the upper plate 21 to prevent capsules 13 from fully extending through holes 22. However, the amplitude of the vibratory drive can be controlled so that retainer plate 24 is not necessary.

Figure 5:
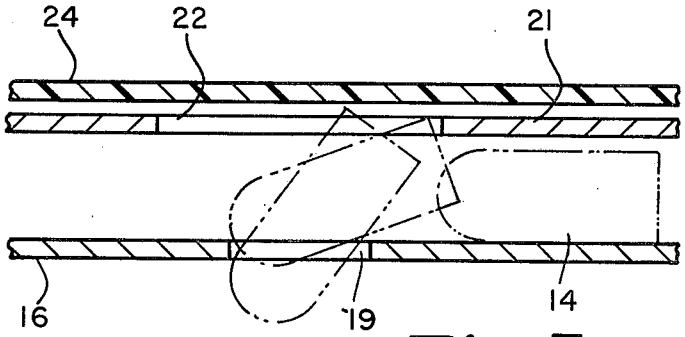

FIG. 5 illustrates how a capsule body 14 is sorted out from the assembled capsules 13 by allowing it to fall through opening 19. This is made possible by controlled dimensioning of holes 19 and 22 and the spacing between plates 16 and 21. The criticality of these dimensions becomes more apparent as one realizes that the length of the capsule body is only sightly less than the overall length of the assembled capsule. In fact, it has been found that if the difference in the length of the assembled capsule and the capsule body equals less than 0.1 inches that the capsule body will not always drop into hole 19 which has been dimensioned to retain the assembled capsule. Thus, referring to FIG. 5, although an assembled size 4 capsule may be only 0.106 inches longer than the capsule body, the assembled capsule will not be able to drop through hole 19 because its extended length will rise and come into contact with the upper plate 21. This prevents the capsule from rising sufficiently to drop into hole 19. Instead, the capsule will continue along its vibratory path across hole 19. However, capsule body 14 will be able to assume an angle of inclination of at least 45 degrees with plate 16 because it is shorter than the capsule 13. This means it will extend through upper hole 22, permitting it to incline about 60 degrees and fall through hole 19. The greater length of assembled capsule 13 means that it will contact the perimeter of hole 22, stopping it from inclining more than about 30–40 degrees with plate 16.

Figure 6:
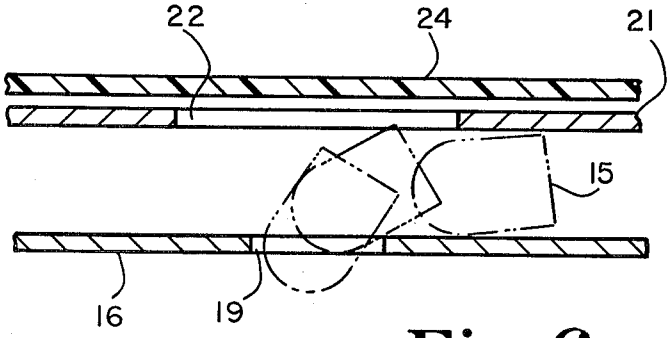

Referring to FIG. 6, the capsule cap 15 is shown dropping through hole 19. This action is easy to achieve once the dimensions have been determined for permitting the escape of a capsule body since the cap is substantially shorter than the body. The following table illustrates dimensions that have been found to be satisfactory with existing capsule sizes 0 through 4.

| Size | Cap Length | Body Length | Joined Length | Cap O.D. | Body O.D. | Spacer | Bottom Hole | Top Hole | Joined length Minus Body Length |
|---|---|---|---|---|---|---|---|---|---|
| 0 | .440 | .728 | .880 | .300 | .289 | .360 | .4375 | .9375 | .152 |
| 1 | .394 | .651 | .788 | .272 | .261 | .315 | .375 | .844 | .137 |
| 2 | .361 | .595 | .722 | .250 | .239 | .272 | .359 | .750 | .127 |
| 3 | .324 | .532 | .648 | .229 | .219 | .260 | .328 | .6875 | .115 |
| 4 | .294 | .482 | .588 | .209 | .199 | .230 | .297 | .6875 | .106 |
| 5 | .237 | .357 | .455 | .193 | .184 | — | — | — | .098 |

As mentioned above, the difference in length of the assembled capsule and the body length should be at least 0.1 inches. If a smaller difference exists it will be difficult to separate unassembled bodies from the joined capsules. Consequently, no acceptable dimensions have been established for size 5 capsules. Observing the statistics for the various dimensions of the capsules, their caps, and bodies, as well as the dimensions for the diameters of the plate holes and space between plates, it will be apparent that there is no precise ratio for determining dimensions. This is the result of the fact that there are no precise ratios that exist with respect to the diameters of the capsules in conjunction with the lengths of their sections and the overall length of an assembled capsule of that particular diameter. However, there is no significant amount of experimentation required in determining what must be done for a capsule size not appearing in this table since the figures set forth in this table provide very clear guidelines on the approximate dimensions one can apply.

These plate dimensions call for a lower hole 19 diameter which is greater than the cap diameter and less than the body 14 length. The spacing of plates 16 and 21 is also a distance greater than the cap diameter and less than the length of the cap. Upper holes 22 have a diameter slightly greater than the joined length of a capsule and slightly more than twice the diameter of holes 19.

In running capsules through the sorting apparatus of this invention it has been found that the percent of sorting out unassembled bodies and caps from assembled capsule at a rate of 1200 capsules per minute generally runs in the neighborhood of 97–99 percent, with almost no caps escaping holes 19.

I claim:

1. Apparatus for sorting capsule components consisting of assembled capsules from unassembled capsule bodies and caps comprising a conveyor plate positioned to receive the capsule components, a vibratory drive coupled to said conveyor plate for effecting progressive movement of said capsule components along said conveyor plate toward an exit chute, said conveyor plate having a plurality of circular holes with a diameter greater than the diameter of the capsule caps and less than the length of the bodies, an upper plate spaced above said conveyor at a distance less than said cap length and greater than said cap diameter, said upper plate having a plurality of circular holes in coaxial alignment, with the holes in said conveyor plate and having a diameter slightly greater than the length of an assembled capsule, said conveyor plate and said upper plate cooperating to permit passage of only said caps and said bodies through the holes in said conveyor plate.

2. Apparatus in accordance with claim 1 in which the holes in said upper plate are positioned very close to each other.

3. Apparatus in accordance with claim 2 in which the dimensioning of the spacing between said conveyor plate and said upper plate allows assembled capsules traveling therethrough to incline a maximum of 40 degrees.

4. Apparatus in accordance with claim 1 in which a retainer plate is closely spaced above said upper plate.

5. Apparatus in accordance with claim 4 in which a mesh section is connected to said conveyor plate for first receiving the capsule components.

6. Apparatus in accordance with claim 5 in which a powder collector is positioned beneath said mesh section.

* * * * *